US009863021B2

(12) United States Patent
Sun

(10) Patent No.: US 9,863,021 B2
(45) Date of Patent: Jan. 9, 2018

(54) HIGH-PERFORMANCE NDFEB RARE EARTH PERMANENT MAGNET WITH COMPOSITE MAIN PHASE AND MANUFACTURING METHOD THEREOF

(71) Applicant: SHENYANG GENERAL MAGNETIC CO., LTD., Shenyang, Liaoning (CN)

(72) Inventor: Baoyu Sun, Liaoning (CN)

(73) Assignee: SHENYANG GENERAL MAGNETIC CO., LTD, Shenyang, Liaoning Province (CN)

( * ) Notice: Subject to any disclaimer, the term of this patent is extended or adjusted under 35 U.S.C. 154(b) by 198 days.

(21) Appl. No.: 14/708,997

(22) Filed: May 11, 2015

(65) Prior Publication Data

US 2015/0248954 A1 Sep. 3, 2015

(30) Foreign Application Priority Data

May 11, 2014 (CN) ..... 2014 1 0195912

(51) Int. Cl.

| | |
|---|---|
| ***H01F 1/057*** | (2006.01) |
| ***B22F 1/00*** | (2006.01) |
| ***C22C 38/00*** | (2006.01) |
| ***C22C 38/16*** | (2006.01) |
| ***C22C 38/14*** | (2006.01) |
| ***C22C 38/12*** | (2006.01) |
| ***C22C 38/10*** | (2006.01) |
| ***C22C 38/06*** | (2006.01) |
| ***C22C 1/00*** | (2006.01) |
| ***C22C 1/02*** | (2006.01) |
| ***C22C 24/00*** | (2006.01) |
| ***C22C 33/02*** | (2006.01) |
| ***H01F 41/02*** | (2006.01) |

(52) U.S. Cl.

CPC ..... *C22C 38/002* (2013.01); *C22C 1/002* (2013.01); *C22C 1/02* (2013.01); *C22C 24/00* (2013.01); *C22C 33/02* (2013.01); *C22C 38/005* (2013.01); *C22C 38/06* (2013.01); *C22C 38/10* (2013.01); *C22C 38/12* (2013.01); *C22C 38/14* (2013.01); *C22C 38/16* (2013.01); *H01F 1/0577* (2013.01); *H01F 41/0273* (2013.01); *B22F 1/0055* (2013.01); *B22F 2998/10* (2013.01); *B22F 2999/00* (2013.01); *C22C 2202/02* (2013.01)

(58) Field of Classification Search
None
See application file for complete search history.

(56) References Cited

U.S. PATENT DOCUMENTS

| | | | | |
|---|---|---|---|---|
| 5,645,651 | A | 7/1997 | Fujimura et al. | |
| 2005/0183791 | A1* | 8/2005 | Hidaka | C22C 1/0441 148/103 |
| 2007/0012380 | A1* | 1/2007 | Tayu | H01F 41/0293 148/105 |
| 2009/0019969 | A1* | 1/2009 | Kato | C22C 33/0278 75/228 |
| 2014/0132377 | A1* | 5/2014 | Nakajima | B22F 3/24 335/302 |
| 2015/0243415 | A1* | 8/2015 | Sun | H01F 41/0266 148/103 |

FOREIGN PATENT DOCUMENTS

| | | | | |
|---|---|---|---|---|
| CN | 1688000 | | 10/2005 | |
| CN | 1688000 | A * | 10/2005 | |
| CN | 101521069 | | 11/2011 | |
| JP | 63065742 | | 12/1988 | |
| JP | 08005664 | | 1/1996 | |
| WO | WO 2013008756 | A1 * | 1/2013 | B22F 3/24 |

OTHER PUBLICATIONS

Machine translation of CN1688000A, Oct. 2005.*

* cited by examiner

*Primary Examiner* — Xiaowei Su

(57) ABSTRACT

A NdFeB rare earth permanent magnet with composite main phase and a manufacturing method thereof are provided. In the composite main phase, a $PR_2(Fe_{1-x-y}Co_xAl_y)_{14}B$ main phase is the core, $ZR_2(Fe_{1-w-n}Co_wAl_n)_{14}B$ main phase surrounds a periphery of the $PR_2(Fe_{1-x-y}Co_xAl_y)_{14}B$ main phase, and no grain boundary phase exists between $ZR_2(Fe_{1-w-n}Co_wAl_n)_{14}B$ main phase and the $PR_2(Fe_{1-x-y}Co_xAl_y)_{14}B$ main phase, wherein ZR represents a group of rare earth elements in which a content of heavy rare earth is higher than an average content of heavy rare earth in the composite main phase, PR represents a group of rare earth elements in which a content of heavy rare earth is lower than an average content of heavy rare earth in the composite main phase. The manufacturing method includes steps of LR—Fe—B-Ma alloy melting, HR—Fe—B-Mb alloy melting, alloy hydrogen decrepitating, metal oxide micro-powder surface absorbing and powdering, magnetic field pressing, sintering and ageing.

12 Claims, No Drawings

HIGH-PERFORMANCE NDFEB RARE EARTH PERMANENT MAGNET WITH COMPOSITE MAIN PHASE AND MANUFACTURING METHOD THEREOF

CROSS REFERENCE OF RELATED APPLICATION

The present invention claims priority under 35 U.S.C. 119(a-d) to CN 201410195912.9, filed May 11, 2014.

BACKGROUND OF THE PRESENT INVENTION

Field of Invention

The present invention relates to a field of rare earth permanent magnet, and more particularly to a high-performance NdFeB rare earth permanent magnet with composite main phase and a manufacturing method thereof.

Description of Related Arts

NdFeB rare earth permanent magnets are more and more widely used due to excellent magnetic properties thereof. For example, the NdFeB rare earth permanent magnets are widely used in medical nuclear magnetic resonance imaging, computer hard disk drivers, stereos, cell phones, etc. With the requirements of energy efficiency and low-carbon economy, the NdFeB rare earth permanent magnets are also used in fields such as automobile parts, household appliances, energy conservation and control motors, hybrid cars and wind power.

In 1983, Japanese patents No. 1,622,492 and No. 2,137,496 firstly disclosed NdFeB rare earth permanent magnets invented by Japanese Sumitomo Metals Industries, Ltd., which disclose features, components and manufacturing methods of the NdFeB rare earth permanent magnets, and confirm that a main phase is a $Nd_2Fe_{14}B$ phase and a grain boundary phase comprises a rich Nd phase, a rich B phase and rare earth oxides. NdFeB rare earth permanent magnets are widely used because of excellent magnetic properties, and are called the king of permanent magnets. U.S. Pat. No. 5,645,651, authorized in 1997, further disclosed adding Co and the main phase having a square structure.

With the wide application of the NdFeB rare earth permanent magnets, rare earth becomes more and more rare. Especially, shortage of heavy rare earth element resource is significant, so that price of the rare earth is continuously increasing. Therefore, after a lot of exploring, double-alloy technology, metal infiltration technology, grain boundary improving or recombining technology, etc. appear. Chinese patent CN101521069B discloses a method of manufacturing NdFeB doped with heavy rare earth hydride nano-particles, wherein an alloy flake is firstly manufactured with strip casting technology, then powder is formed by hydrogen decrepitating and jet milling, the above power is mixed with heavy rare earth hydride nano-particles formed by physical vapor deposition technology, and then the NdFeB magnet is manufactured through conventional processes such as magnetic field pressing and sintering. Although the Chinese patent discloses a method to enhance coercivity of the magnet, there is problem for mass production.

Chinese patent CN1688000 discloses a method for improving coercivity of the sintered NdFeB by adding nanometer oxides in the grain boundary phase. The method is an improvement of the double-alloy method. Firstly, the main phase alloy and the grain boundary phase alloy respectively utilize the casting process to manufacture NdFeB alloy ingots, or utilize the strip casting flake process to manufacture strip casting alloy flakes, then respectively utilize the hydrogen decrepitating method or the crusher for decrepitating, then powder with jet milling to manufacture powder with a size of 2-10 μm; then add 2-20% dispersed nanometer oxides and 1-10% anti-oxidants by weight into the grain boundary phase powder and evenly mix in the mixer; then mix the grain boundary phase alloy powder doped with the nanometer oxides with the main phase alloy powder, wherein the grain boundary phase alloy powder is 1-20% by weight, and simultaneously, add 0.5-5% gasoline, evenly mix in the mixer for manufacturing mixture powder; press the mixture powder at the magnetic field of 1.2-2.0 T, then sintering for manufacturing the NdFeB magnet. The core technique of the present invention is: the grain boundary phase is modified by evenly distributing the nanometer oxides in the grain boundary phase to improve the coercivity of the NdFeB magnet; the main phase and the grain boundary phase are respectively molten, powdered and mixed repeatedly in the present invention. The NdFeB fine powder is very easy to be oxidized, so the process is complex and not easy to be controlled. Furthermore, when the main phase alloy is molten, due to low content of rare earth, a composition of the main phase alloy is close to that of $Nd_2Fe_{14}B$ phase, it is easy to produce α-Fe so that the remanence is reduced; easy to produce the main phase while melting the grain boundary phase so that the coercivity is affected. Furthermore, due to large surface area of the nanometer oxide, it is dangerous to explode while transporting and using. The nanometer oxide has difficult manufacturing process and high cost, which affects the application of NdFeB.

SUMMARY OF THE PRESENT INVENTION

After researching and exploring, the present invention provides a high-performance NdFeB rare earth permanent magnet with composite main phase and a manufacturing method thereof, which overcomes the shortcomings of the prior art, significantly improves magnetic energy product, coercivity, corrosion resistance and processing property of the NdFeB rare earth permanent magnet. The method is suitable for mass production and uses less heavy rare earth elements which are expensive and rare. The method is important for widening application of the NdFeB rare earth permanent magnet, especially in fields such as energy conservation and control motors, automobile parts, new energy cars and wind power. The present invention also discloses that inhibition grains capable of improving magnetic energy product, coercivity, corrosion resistance and processing property of the NdFeB rare earth permanent magnet grow up, especially the La oxide particles, formed in the grain boundary by adding La, are capable of effectively inhibiting abnormal growth of grains during the sintering process. Therefore, a composite main phase structure, that a $PR_2(Fe_{1-x-y}Co_xAl_y)_{14}B$ main phase is the core, $ZR_2(Fe_{1-w-n}Co_wAl_n)_{14}B$ main phase surrounds a periphery of the $PR_2(Fe_{1-x-y}Co_xAl_y)_{14}B$ main phase, and no grain boundary phase exists between $ZR_2(Fe_{1-w-n}Co_wAl_n)_{14}B$ main phase and the $PR_2(Fe_{1-x-y}Co_xAl_y)_{14}B$ main phase, is formed.

A high-performance NdFeB rare earth permanent magnet with composite main phase has a composition comprising $19 \le Ra \le 32$, $0.8 \le B \le 1.2$, $0 \le M \le 4.0$, $0.5 \le Rb \ge 10$, $30 \le Ra + Rb \le 33$, Fe and impurities by weight percent, wherein the Ra comprises at least two rare earth elements selected from a group consisting of La, Ce, Pr and Nd, wherein the Ra at least comprises Nd;

the Rb is selected from a group consisting of Dy, Tb, Ho and Gd;

the M is selected from a group consisting of Al, Co, Nb, Ga, Zr, Cu, V, Ti, Cr, Ni, Hf and Y.

Preferably, the Ra comprises at least two rare earth elements selected from a group consisting of La, Ce, Pr and Nd, wherein the R at least comprises Pr and Nd, and Pr/Nd=0.25-0.45.

A content of Al is in a range of $0.1 \leq Al \leq 0.9$, and preferably, $0.2 \leq Al \leq 0.5$.

A content of Co is in a range of $0 \leq Co \leq 5$, and preferably, $0.8 \leq Co \leq 2.4$.

A content of Cu is in a range of $0.1 \leq Cu \leq 0.5$, and preferably, $0.1 \leq Cu \leq 0.2$.

A content of Ga is in a range of $0.05 \leq Ga \leq 0.3$, and preferably, $0.1 \leq Ga \leq 0.2$.

A content of Nb is in a range of $0.1 \leq Nb \leq 0.9$, and preferably, $0.2 \leq Nb \leq 0.6$.

A content of Zr is in a range of $0.05 \leq Al \leq 0.5$, and preferably, $0.1 \leq Zr \leq 0.2$.

The high-performance NdFeB rare earth permanent magnet with composite main phase comprises a composite main phase and a grain boundary phase. In the composite main phase, a $PR_2(Fe_{1-x-y}Co_xAl_y)_{14}B$ main phase is the core, $ZR_2(Fe_{1-w-n}Co_wAl_n)_{14}B$ main phase surrounds a periphery of the $PR_2(Fe_{1-x-y}Co_xAl_y)_{14}B$ main phase, and no grain boundary phase exists between $ZR_2(Fe_{1-w-n}Co_wAl_n)_{14}B$ main phase and the $PR_2(Fe_{1-x-y}Co_xAl_y)_{14}B$ main phase, wherein ZR represents a group of rare earth elements in which a content of heavy rare earth is higher than an average content of heavy rare earth in the composite main phase, PR represents a group of rare earth elements in which a content of heavy rare earth is lower than an average content of heavy rare earth in the composite main phase, $0 \leq x \leq 0.3$, $0 \leq y \leq 0.2$, $0 \leq w \leq 0.3$, and $0 \leq n \leq 0.2$. Ra oxide particles and Nd oxide particles exist in the grain boundary phase, and an oxygen content in the grain boundary phase is higher that in the composite main phase.

Experiments show that the smaller w and n, the higher the magnetic properties, when w=0 and n=0, the magnetic properties are maximized, that is to say, that the core $PR_2(Fe_{1-x-y}Co_xAl_y)_{14}B$ main phase of the composite main phase is $PR_2Fe_{14}B$, the properties are best.

The high-performance NdFeB rare earth permanent magnet containing La comprises the composite main phase and the grain boundary phase, an average grain size is in a range of 3-15 μm, and preferably, 5-7 μm.

La oxide particles and Nd oxide particles exist in the grain boundary phase of the high-performance NdFeB rare earth permanent magnet with the composite main phase.

$La_2O_3$ and $Nd_2O_3$ particles exist in the grain boundary phase of the high-performance NdFeB rare earth permanent magnet with the composite main phase.

La oxide particles and Nd oxide particles exist in the grain boundary phase at a juncture of more than two $ZR_2(Fe_{1-w-n}Co_wAl_n)_{14}B$ phase grains.

The present invention is achieved by the following manufacturing method.

The raw material comprises LR—Fe—B-Ma alloy, HR—Fe—B-Mb alloy and metal oxide micro-powder, wherein the LR comprises at least two rare earth elements and comprises at least Nd and Pr, the Ma is selected from a group consisting of Al, Co, Nb, Ga, Zr, Cu, V and Mo, the Mb is selected from a group consisting of Al, Co, Nb, Ga, Zr, Cu, V, Ti, Cr, Ni, Hf, Y and Mo, the HR comprises at least one rare earth element and at least comprises Dy; preferably, the metal oxide micro-powder is rare earth metal oxides except lanthanum oxide and cerium oxide, or is selected from a group consisting of Al metal oxide, Co metal oxide, Nb metal oxide, Ga metal oxide, Zr metal oxide, Cu metal oxide, V metal oxide, Mo metal oxide, Fe metal oxide and Zn metal oxide; and further preferably, the metal oxide is selected from a group consisting of $Dy_2O_3$, $Tb_2O_3$ and $Al_2O_3$.

Preferably, the LR is selected from a group consisting of Nd, Pr, Ce, Gd and Ho; and more preferably, the LR comprises Nd and Pr; and even more preferably, the LR comprises Nd and Pr, wherein a content of Nd is 74-81% and that of Pr is 26-19%. When the LR comprises Nd and Pr, remanence and magnetic energy product of the magnet is maximized, wherein when the content of Nd is 74-81% and that of Pr is 26-19%, the cost is minimized.

Preferably, the Ma comprises Al, Co and Cu; and more preferably, Ma is Al; and even more preferably, the LR—Fe—B-Ma alloy is transformed to LR—Fe—B alloy in which no Ma exists. When a content of the Ma in the LR—Fe—B-Ma alloy is reduced, remanence and magnetic energy product of the NdFeB magnet are increased, the process stability thereof is reduced, and remanence and magnetic energy product thereof are maximized when no Ma exists in the LR—Fe—B alloy.

Preferably, the Mb comprises Al, Co, Nb, Ga, Zr and Cu; and more preferably, the Mb is selected from a group consisting of Al, Co, Nb, Ga and Cu; and even more preferably, the Mb comprises Al, Co, Ga, Zr and Cu; and extremely preferably, the Mb comprises Al, Co, Ga, and Cu. When in the HR—Fe—B-Mb alloy, the Mb comprises Al, Co, Ga, and Cu, the grains of the HR—Fe—B-Mb alloy are refined to obtain the better magnetic properties and corrosion resistance of the magnet. When the Mb comprises Al, Co, Ga, Zr and Cu, the grains of the HR—Fe—B-Mb alloy are further refined to evenly distribute the grain boundary. When the Mb comprises Al, Co, Nb, Ga, Zr and Cu, the grains of the HR—Fe—B-Mb alloy are even more improved to optimize the distribution of the grain boundary.

Preferably, when the metal oxide powder is $Tb_2O_3$, the magnetic properties are highest; when metal oxide powder is $Dy_2O_3$, the magnetic properties are higher; when $Al_2O_3$ is added to the metal oxide powder, the magnetic properties are lower than $Dy_2O_3$, but the corrosion resistance is best. When $Tb_2O_3$, $Dy_2O_3$ and $Al_2O_3$ are all added to the metal oxide powder together, the magnetic properties are improved and the manufacturing cost is reduced, and the corrosion resistance of the magnet is increased. Preferably, a particle size of the powder is less than 2 μm; and more preferably, 20-100 nm; and even more preferably, 0.5-1 μm. While powdering with jet-milling after adding the metal oxide powder, the metal oxide powder is further ground to adsorb the surface of the grain boundary phase and the composite main phase. While sintering, due to the strongest binding force of La and O, at a certain temperature and vacuum, La preferentially binds O for forming La oxide particles, the replaced metal element in the metal oxide powder enters the composite main phase or surrounds a periphery of the composite main phase, thereby significantly improving the coercivity and corrosion resistance of the magnet. When no La exists in the magnet, priorities in combination with O are from Ce to Pr to Nd.

The manufacturing method comprises steps of:

(1) melting LR—Fe—B-Ma alloy which comprises:

firstly melting an LR—Fe—B-Ma raw material under vacuum or argon protection with induction heating for forming an alloy, refining before casting the alloy in a melted state onto a rotation roller with water cooling function through a tundish, and cooling the molten alloy with the rotation roller for forming alloy flakes, wherein an average grain size of each of the alloy flakes is 1.5-3.5 μm;

(2) melting HR—Fe—B-Mb alloy which comprises:

firstly melting an HR—Fe—B-Mb raw material under vacuum or argon protection with induction heating for forming an alloy, refining before casting the alloy in a melted state onto a rotation roller with water cooling function through a tundish, and cooling the molten alloy with the rotation roller for forming alloy flakes, wherein an average grain size of each of the alloy flakes is 0.1-2.9 μm;

(3) making alloy hydrogen decrepitating which comprises:

sending the LR—Fe—B-Ma alloy and the HR—Fe—B-Mb alloy into a vacuum hydrogen decrepitation device, evacuating before injecting hydrogen for hydrogen absorption, wherein a hydrogen absorption temperature is 80-300° C.; heating after hydrogen absorption and evacuating for dehydrogenating, wherein a dehydrogenating temperature is 350-900° C., a dehydrogenating time is 3-15 h; and then cooling the alloy, wherein after evacuating for dehydrogenating, a certain amount of hydrogen may be injected within a temperature range of 100-600° C., and then the alloy is cooled;

(4) metal oxide powder surface adsorbing and powdering which comprises:

adding the LR—Fe—B-Ma alloy and the HR—Fe—B-Mb alloy which are hydrogen decrepitated in the step (3), and the metal oxide micro-powder into a mixer for mixing, wherein mixing is made under nitrogen protection, lubricant or anti-oxidant may be added, a mixing time is more than 30 min; powdering with jet milling after mixing, wherein an average particle size of the powder is 1-3.3 μm, wherein when the LR—Fe—B-Ma alloy and the HR—Fe—B-Mb alloy which are hydrogen decrepitated in the step (3), and the metal oxide micro-powder are added into the mixer for mixing, a certain amount of hydrogen may be added;

wherein powdering with jet milling process comprises: under nitrogen atmosphere or not, adding the mixed powder into a hopper on a top portion of a feeder, moving the mixed powder into a milling room through the feeder, milling with high-speed flow from a spray nozzle, rising the powder milled with the flow; sorting powder suitable for powdering with a sorting wheel and collecting in a cyclone collector; discharging fine powder coated with the metal oxide micro-powder from an air exhaust pipe of the cyclone collector with air flow, and then collecting in a collector after the cyclone collector, and then mixing under nitrogen protection to obtain the alloy powder; and (5) magnetic field pressing, sintering and ageing which comprises:

under nitrogen protection, magnetic field pressing the above alloy powder, and then sintering and ageing under vacuum or argon protection for manufacturing the NdFeB rare earth permanent magnet, wherein magnetic field pressing comprises sending the alloy powder into a nitrogen protection sealed magnetic field pressing machine under nitrogen protection, weighting before adding to a cavity of a mould already assembled, then magnetic field pressing; after pressing, opening the mould and obtaining a magnetic block; surrounding the magnetic block with a plastic or rubber bag under nitrogen protection, sending the magnetic block into an isostatic pressing machine for isostatic pressing, then sending the magnetic block which is still surrounded into a nitrogen protection loading tank of a vacuum sintering furnace; unsurrounding the magnetic block with gloves in the nitrogen protection loading tank and sending to a sintering case;

wherein sintering and ageing comprises sending the sintering case in the nitrogen protection loading tank of the vacuum sintering furnace into a heating chamber of the vacuum sintering furnace under nitrogen protection, evacuating before heating, keeping a temperature at 200-400° C. for 2-10 h, then keeping the temperature at 400-600° C. for 5-12 h, then keeping the temperature at 600-1050° C. for 5-20 h to pre-sinter, then keeping the temperature at 950-1070° C. for 1-6 h to sinter, then first ageing at the temperature of 800-950° C. and second ageing at the temperature of 450-650° C., rapidly cooling after second ageing for manufacturing the sintered NdFeB permanent magnet, machining the sintered NdFeB permanent magnet and surface-processing to manufacture various permanent magnetic devices.

A density of the pre-sintered magnet is 7-7.4 g/cm$^3$, and a density of the sintered magnet is 7.5-7.7 g/cm$^3$.

The method of manufacturing a high-performance NdFeB rare earth permanent magnet with composite main phase is characterized in that the metal oxide micro-powder is $Dy_2O_3$ micro-powder heat-processed at a temperature of 600-1200° C.

The metal oxide micro-powder is $Al_2O_3$ micro-powder.

The alloy melting comprises firstly melting a raw material under vacuum or argon protection with induction heating for forming an alloy, refining at 1400-1470° C. before casting the alloy in a melted state onto a rotation roller with water cooling function with a rotating speed of 1-10 m/s through a tundish, and cooling the alloy with the rotation roller for forming alloy flakes, falling the alloy flakes onto the rotation plate for secondary cooling after the alloy flakes leaving the rotation roller, and outputting the alloy flakes after cooling.

More preferably, the alloy melting comprises firstly melting a raw material under vacuum or argon protection with induction heating for forming an alloy, refining at 1400-1470° C. before casting the alloy in a melted state onto a rotation roller with water cooling function with a rotating speed of 1-10 m/s through a tundish, and cooling the alloy with the rotation roller for forming alloy flakes, falling the alloy flakes after the alloy flakes leaving the rotation roller, decrepitating the alloy flakes after falling, then entering a material receiving box, and then cooling the alloy flakes by inert gases.

Even more preferably, the alloy melting comprises firstly melting a raw material under vacuum or argon protection with induction heating for forming an alloy, refining at 1400-1470° C. before casting the alloy in a melted state onto a rotation roller with water cooling function with a rotating speed of 1-4 m/s through a tundish, and cooling the alloy with the rotation roller for forming alloy flakes with a temperature of larger than 400° C. and smaller than 700° C., falling the alloy flakes onto a cooling plate for secondary cooling after the alloy flakes leaving the rotation roller, wherein a temperature of each of the alloy flakes is less than 400° C. after secondary cooling, then decrepitating the alloy flakes before keeping a temperature of 200-600° C., and then cooling the alloy flakes by inert gases.

The HR—Fe—B-Mb alloy melting comprises firstly melting an HR—Fe—B-Mb raw material under vacuum or argon protection with induction heating for forming an alloy, casting the alloy in a melted state into a water cooling mold for forming alloy ingots or onto a rotation roller with water cooling function through a tundish, and cooling the molten alloy with the rotation roller for forming alloy flakes, crushing the alloy ingots or the alloy flakes into small blocks with a side length less than 10 mm, adding the alloy blocks to a water cooling copper crucible of an arc heating vacuum furnace under argon atmosphere, heating the alloy blocks with arc for melting the alloy blocks into molten alloy liquid, contacting a periphery of a high-speed rotating molybdenum wheel with water cooling function with the molten alloy liquid in such a manner that the molten alloy liquid is thrown out to form a fibrous La—HR—Fe—B-Mb alloy with an average grain size of 0.1-2.9 μm.

Preferably, the average grain size of the La—HR—Fe—B-Mb alloy is 2-3 μm, and an average grain size of the HR—Fe—B-Mb alloy is 0.6-1.9 μm.

By improving the components and the manufacturing processes of the magnet, the present invention is capable of significantly improving the magnetic properties, and especially, coercivity and magnetic energy product. Under the same coercivity, the usage of the heavy rare earth is significantly reduced to save scarce rare earth resources. The NdFeB rare earth permanent magnet is easy to be oxidized, which seriously affects the applications in vehicles, wind power and other industries. The present invention significantly reduces weight loss, improves antioxidant capacity of the magnet, and expands the application ranges of the NdFeB rare earth permanent magnet.

The remanence and coercivity of $La_2Fe_{14}B$ are obviously lower than those of $Nd_2Fe_{14}B$, $Pr_2Fe_{14}B$, $Dy_2Fe_{14}B$ and $Tb_2Fe_{14}B$, and especially, the coercivity of $La_2Fe_{14}B$ is much less than that of $Nd_2Fe_{14}B$, $Pr_2Fe_{14}B$, $Dy_2Fe_{14}B$ and $Tb_2Fe_{14}B$. It is generally considered that when La is added to the magnet, the magnetic properties are decreased. By further researches, the present invention finds that a method of improving remanence, coercivity, magnetic energy product and corrosion resistance of the magnet through adding La and a new manufacturing method thereof.

These and other objectives, features, and advantages of the present invention will become apparent from the following detailed description, the accompanying drawings, and the appended claims.

DETAILED DESCRIPTION OF THE PREFERRED EMBODIMENT

The significant effects of the present invention are further illustrated by comparative embodiments.

Embodiment 1

Melting 600 Kg LR—Fe—B-Ma alloy and 600 Kg HR—Fe—B-Mb alloy respectively selected from the components of embodiment 1 in Table 1; casting the alloys in a melted state onto a rotation copper roller with water cooling function, so as to be cooled for forming alloy flakes; adjusting a cooling speed of the LR—Fe—B-Ma alloy and the HR—Fe—B-Mb alloy by adjusting a rotation speed of the rotation copper roller for obtaining the LR—Fe—B-Ma alloy with an average grain size of 2.8 μm and the HR—Fe—B-Mb alloy with an average grain size of 1.8 μm; selecting the LR—Fe—B-Ma alloy flakes and HR—Fe—B-Mb alloy flakes with a ratio in Table 1 for hydrogen decrepitating; after hydrogen decrepitating, sending the alloy flakes and metal oxides with a ratio in Table 1 into a mixer, mixing under nitrogen protection for 60 min before powdering with jet milling; sending the powder from a cyclone collector and the super-fine powder from the filter into a post-mixer for post-mixing, wherein post-mixing is provided under nitrogen protection with a mixing time of 90 min; an oxygen content in protection atmosphere is less than 100 ppm; then sending into a nitrogen protection magnetic field orientation pressing machine for pressing, wherein an orientation magnetic field strength is 1.8 T, an in-cavity temperature is 3° C., a size of a magnet is 40×30×20 mm, and an orientation direction is a 20 size direction; packaging in a protection tank after pressing, then outputting for isostatic pressing; sending into a sintering furnace for pre-sintering, wherein a pre-sintering temperature is kept at 940° C. for 15 h and a pre-sintering density is 7.3 g/cm$^3$; then sintering, firstly ageing and secondly ageing, wherein a sintering temperature is kept at 1070° C. for 1 h; taking out the magnetic block for being machined, then measuring magnetic performance and weight loss, recording results in Table 1, wherein a weight percentage ratio of the sintered magnet after testing is $(Nd_{0.7}Pr_{0.3})_{29.5}Dy_{1.0}B_{0.9}Al_{0.1}Co_{1.2}Cu_{0.15}Fe_{residual}$, and the measurement results of magnetic energy product, coercivity and weight loss also are recorded in Table 1.

Contrast Example 1

Selecting the magnet with a composition of $(Nd_{0.7}Pr_{0.3})_{29.5}Dy_{1.0}B_{0.9}Al_{0.1}Co_{1.2}Cu_{0.15}Fe_{residual}$ of the contrast example 1 in Table 2, firstly melting alloy, casting the alloy in a melted state onto a rotation copper roller with water cooling function, so as to be cooled for forming alloy flakes; then hydrogen decrepitating, powdering with jet milling, pressing by a magnetic field orientation pressing machine, isostatic pressing, sintering, firstly ageing and secondly ageing the alloy flakes, machining, measuring magnetic properties and weight loss, and recording results in Table 1.

In spite that the embodiment 1 and the contrast example 1 has same magnetic composition, the magnetic energy product, coercivity and weight loss of the present invention of the embodiment 1 of the present invention are significantly higher than those of the contrast example 1.

The other compositions of embodiment 1 are unchanged, the content of Co is changed, when $0 \le Co \le 5$, the metal oxide is in a range of 0.01-0.05%, the magnetic performance is changed with the increase of the content of Co, the change range is less than 4%, the performance is significantly higher than that of the contrast example 1. Preferably, the content of Co is $0 \le Co \le 3$, the performance change is smaller. Further preferably, the content of Co is $1.0 \le Co \le 2.4$, the performance change is much smaller and lower than 2%. The content of Co is unchangeable, the content of Cu is adjusted, when $0 \le Cu \le 0.3$, the metal oxide is in a range of 0.01-0.05%, the performance is changed with the change of the content of Cu, the change range is less than 3%, the performance is significantly higher than that of the contrast example 1. Preferably, the content of Cu is $0.1 \le Cu \le 0.3$, the performance is changed with the change of the content of Cu, and the change range is less than 2%. Further preferably, the content of Cu is $0.1 \le Co \le 0.2$, the performance is changed with the change of the content of Cu, and the change range is less than 1%. Experiments show that when both Co and Cu are added, the content of Co meets $0.8 \le Co \le 2.4$, and the content of Cu meets $0.1 \le Cu \le 0.2$, the magnetic performance and corrosion resistance are best.

The material compositions and experimental method of embodiment 1 are unchangeable, the variety and content of the metal oxide are changed. Experiments show that when the metal oxide micro-powder is $Al_2O_3$, the content thereof is 0.01-0.05%, the magnetic performance is increased with the increase of the content, the content is 0.01-0.08%, the magnetic performance keeps higher than the performance with the content of 0.01; when the metal oxide micro-powder is replaced by $Dy_2O_3$ and $Tb_2O_3$, the same rules exist, the performance of $Dy_2O_3$ is higher than that of $Al_2O_3$, the performance of $Tb_2O_3$ is higher than $Dy_2O_3$. Preferably, the content of the metal oxide micro-powder is 0.01-0.05%. Further preferably, the content of the metal oxide micro-powder is 0.02-0.03%. Preferably, the metal oxide is $Al_2O_3$; and more preferably, $Dy_2O_3$, and even more preferably, $Tb_2O_3$. Preferably, both $Dy_2O_3$ and $Al_2O_3$ are added to further improve the performance of the magnet. More preferably, both $Al_2O_3$ and $Tb_2O_3$ or both $Tb_2O_3$ and $Dy_2O_3$ are added to further improve the performance of the magnet. Even more preferably, $Dy_2O_3$, $Al_2O_3$ and $Tb_2O_3$ are added to further improve the performance of the magnet.

Embodiment 2

Melting 600 Kg LR—Fe—B-Ma alloy and 600 Kg HR—Fe—B-Mb alloy respectively selected from the components of embodiment 2 in Table 1; casting the alloys in a melted state onto a rotation copper roller with water cooling function, so as to be cooled for forming alloy flakes; adjusting a cooling speed of the LR—Fe—B-Ma alloy and the HR—Fe—B-Mb alloy by adjusting a rotation speed of the rotation copper roller for obtaining the LR—Fe—B-Ma alloy with an average grain size of 2.3 μm and the HR—Fe—B-Mb alloy with an average grain size of 1.3 μm; selecting the LR—Fe—B-Ma alloy flakes and HR—Fe—B-Mb alloy flakes with a ratio in Table 1 for hydrogen decrepitating; after hydrogen decrepitating, sending the alloy flakes and metal oxides with a ratio in Table 1 into a mixer, mixing under nitrogen protection for 40 min before powdering with jet milling; sending the powder from a cyclone collector and the super-fine powder from the filter into a post-mixer for post-mixing, wherein post-mixing is provided under nitrogen protection with a mixing time of 70 min; an oxygen content in protection atmosphere is less than 50 ppm; then sending into a nitrogen protection magnetic field orientation pressing machine for pressing, wherein an orientation magnetic field strength is 1.8 T, an in-cavity temperature is 4° C., a size of a magnet is 40×30×20 mm, and an orientation direction is a 20 size direction; packaging in a protection tank after pressing, then outputting for isostatic pressing; sending into a sintering furnace for pre-sintering, wherein a pre-sintering temperature is kept at 910° C. for 10 h and a pre-sintering density is 7.2 g/cm$^3$; then sintering, firstly ageing and secondly ageing, wherein a sintering temperature is kept at 1060° C. for 1 h; taking out the magnetic block for being machined, then measuring magnetic performance and weight loss, recording results in Table 1, wherein a weight percentage ratio of the sintered magnet after testing is $La_1(Nd_{0.75}Pr_{0.25})_{24}Dy_4Tb_2Co_1Cu_{0.1}B_{0.95}Al_{0.2}Ga_{0.1}Fe_{residual}$, and the measurement results also are recorded in Table 1.

Contrast Example 2

Selecting the magnet with a composition of $La_1(Nd_{0.75}Pr_{0.25})_{24}Dy_4Tb_2Co_1Cu_{0.1}B_{0.95}Al_{0.2}Ga_{0.1}Fe_{residual}$ in Table 2 to compare, the experimental method is same as that in the comparative 1, the measurement results also are recorded in Table 1.

Generally, when Pr or Nd is replaced by La, the magnetic performance is significantly reduced. It can be seen from Table 1, when 1% ($Nd_{0.75}Pr_{0.25}$) is replaced by 1% La, the magnetic performance is significantly improved by the technical process of the present invention. The contents of other compositions are unchanged, only the content of La is changed. Experiments show when 0≤La≤2.4, the magnetic performance and the corrosion resistance are unchanged; when 2.5≤La≤3, the magnetic performance and the corrosion resistance are slightly decreased; when 3.1≤La≤4.5, the magnetic performance and the corrosion resistance can be decreased to less than 3%; when 5≤La≤9, the magnetic performance and the corrosion resistance can be decreased to less than 5%. Therefore, preferably, the content of La is 5≤La≤9, and further preferably, 3.1≤La≤4.5, and further preferably, 2.5≤La≤3.

When La is replaced by Ce, that is to say, that when the magnet with a composition of $Ce_1(Nd_{0.75}Pr_{0.25})_{24}Dy_4Tb_2Co_1Cu_{0.1}B_{0.95}Al_{0.2}Ga_{0.1}Fe_{residual}$ is selected to test, the same rules are obtained. Therefore, preferably, the content of Ce is 5≤Ce≤9, and more preferably, 3.1≤Ce≤4.5, and even more preferably, 2.5≤Ce≤3.

Embodiment 3

Melting 600 Kg LR—Fe—B-Ma alloy and 600 Kg HR—Fe—B-Mb alloy respectively selected from the components of embodiment 3 in Table 1; casting the alloys in a melted state onto a rotation copper roller with water cooling function, so as to be cooled for forming alloy flakes; adjusting a cooling speed of the LR—Fe—B-Ma alloy and the HR—Fe—B-Mb alloy by adjusting a rotation speed of the rotation copper roller for obtaining the LR—Fe—B-Ma alloy with an average grain size of 2.8-3.2 μm and the HR—Fe—B-Mb alloy with an average grain size of 2.1-2.4 μm; selecting the LR—Fe—B-Ma alloy flakes and HR—Fe—B-Mb alloy flakes with a ratio in Table 1 for hydrogen decrepitating; after hydrogen decrepitating, sending the alloy flakes and metal oxides with a ratio in Table 1 into a mixer, mixing under nitrogen protection for 90 min before powdering with jet milling; sending the powder from a cyclone collector and the super-fine powder from the filter into a post-mixer for post-mixing, wherein post-mixing is provided under nitrogen protection with a mixing time of 60 min; an oxygen content in protection atmosphere is less than 150 ppm; then sending into a nitrogen protection magnetic field orientation pressing machine for pressing, wherein an orientation magnetic field strength is 1.5 T, a size of a magnet is 40×30×20 mm, and an orientation direction is a 20 size direction; packaging in a protection tank after pressing, then outputting for isostatic pressing; sending into a sintering furnace for pre-sintering, wherein a pre-sintering temperature is kept at 990° C. for 8 h and a pre-sintering density is 7.4 g/cm$^3$; then sintering, firstly ageing and secondly ageing, wherein a sintering temperature is kept at 1080° C. for 1 h; taking out the magnetic block for being machined, then measuring magnetic performance and weight loss, recording results in Table 1, wherein the composition of the sintered magnet after testing is $Ce_{1.5}(Nd_{0.8}Pr_{0.2})_{20}Dy_6Ho_2Gd_2Co_{2.4}Cu_{0.2}B_{1.0}Al_{0.3}Ga_{0.1}Zr_{0.1}Nb_{0.1}Fe_{residual}$, and the measurement results also are recorded in Table 1.

Contrast Example 3

Selecting the magnet with a composition of $Ce_{1.5}(Nd_{0.8}Pr_{0.2})_{20}Dy_6Ho_2Gd_2Co_{2.4}Cu_{0.2}B_{1.0}Al_{0.3}Ga_{0.1}Zr_{0.1}Nb_{0.1}Fe_{residual}$ according to the contrast example 3 in Table 2, firstly melting alloy, casting the alloy in a melted state onto a rotation copper roller with water cooling function, so as to be cooled for forming alloy flakes; then hydrogen decrepitating, powdering with jet milling, pressing by a magnetic field orientation pressing machine, isostatic pressing, sintering, firstly ageing and secondly ageing the alloy flakes, machining, measuring magnetic performance and weight loss, and recording results in Table 1.

Compare the measurement results of embodiment 3 with those of the contrast example 3, the magnetic performance and corrosion resistance of embodiment 3 are significantly higher than those of the contrast example 3, which further illustrates the advantages of the present invention.

It can be proved by embodiments 1-3 and contrast examples 1-3 that the technical solution of the present invention has obvious advantages. Adding Al, Ga, Zr and Nb can significantly improve the magnetic performance and corrosion resistance of the magnet. Preferably, the contents of Al, Ga, Zr and Nb are respectively $0 \leq Al \leq 0.6$, $0 \leq Ga \leq 0.2$, $0 \leq Zr \leq 0.3$, $0 \leq Nb \leq 0.3$; and further preferably, $0.1 \leq Al \leq 0.3$, $0.05 \leq Ga \leq 0.15$, $0.1 \leq Zr \leq 0.2$, $0.1 \leq Nb \leq 0.2$,

TABLE 1 compound and performance in embodiments and contrast example

| | | Embodiment 1 | Contrast example 1 | Embodiment 2 | Contrast example 2 | Embodiment 3 | Contrast example 3 |
|---|---|---|---|---|---|---|---|
| LR-Fe-B-Ma (Wt %) | Pr | 9.15 | 9 | 7.5 | 5 | 6 | 4.3 |
| | Nd | 21.35 | 21 | 22.5 | 20 | 24 | 17.2 |
| | La | | | 1.0 | | | |
| | Ce | | | | | 1.5 | |
| | Dy | 0 | 1 | 0 | 4 | | 6 |
| | Tb | 0 | 0 | 0 | 2 | | |
| | Ho | | | | | | 2 |
| | Gd | | | | | | 2 |
| | Co | 1.0 | 1.0 | 1.2 | 1.2 | 2.4 | 2.4 |
| | Cu | 0.1 | 0.1 | 0.15 | 0.15 | 0.2 | 0.2 |
| | B | 0.9 | 0.9 | 0.95 | 0.95 | 1.0 | 1.0 |
| | Al | 0.1 | 0.1 | 0.2 | 0.2 | 0.3 | 0.3 |
| | Ga | | | 0.1 | 0.1 | 0.1 | 0.1 |
| | Zr | | | | | 0.1 | 0.1 |
| | Nb | | | | | 0.1 | 0.1 |
| | Fe | residual | residual | residual | residual | residual | residual |
| | Alloy ratio | 90% | 100% | 80% | 100% | 60% | 100% |
| HR-Fe-B-Ma alloy (Wt %) | Dy | 10 | | 20 | | 15 | |
| | La | | | 1 | | | |
| | Ce | | | | | 1.5 | |
| | Pr | 6.15 | | 0.25 | | 1 | |
| | Nd | 14.35 | | 0.75 | | 4 | |
| | Tb | 0 | | 10 | | | |
| | Ho | | | | | 5 | |
| | Gd | | | | | 5 | |
| | Co | 1.0 | | 1.2 | | 2.4 | |
| | Cu | 0.1 | | 0.15 | | 0.2 | |
| | B | 0.9 | | 0.95 | | 1.0 | |
| | Al | 0.1 | | 0.2 | | 0.3 | |
| | Ga | | | 0.1 | | 0.1 | |
| | Zr | | | | | 0.1 | |
| | Nb | | | | | 0.1 | |
| | Fe | | | residual | | residual | |
| | Alloy ratio | 10% | 0 | 20% | 0 | 40% | 0 |
| Oxide micro-powder (Wt %) | $Dy_2O_3$ | 0.01 | | 0.02 | | 0.03 | |
| | $Tb_2O_3$ | | | 0.01 | | 0.01 | |
| | $Al_2O_3$ | 0.01 | | | | 0.01 | |
| | total | 0.02 | | 0.03 | | 0.05 | |
| Magnetic energy product (MGOe) | | 48 | 46 | 43 | 38 | 30 | 27 |
| Coercivity (KOe) | | 21 | 15 | 33 | 27 | 36 | 31 |
| Magnetic energy product + coercivity | | 69 | 61 | 76 | 65 | 66 | 58 |
| Weight loss ($mg/cm^2$) | | 1 | 4 | 2 | 6 | 3 | 5 |

TABLE 2

Composition of rare earth permanent magnet alloy in contrast example

| No | Composition |
|---|---|
| Contrast example 1 | $(Nd_{0.7}Pr_{0.3})_{29.5}Dy_{1.0}B_{0.9}Al_{0.1}Co_{1.2}Cu_{0.15}Fe_{residual}$ |
| Contrast example 2 | $(Nd_{0.75}Pr_{0.25})_{25}Dy_4Tb_2Co_1Cu_{0.1}B_{0.95}Al_{0.2}Ga_{0.1}Fe_{residual}$ |
| Contrast example 3 | $(Nd_{0.8}Pr_{0.2})_{21.5}Dy_6Ho_2Gd_2Co_{2.4}Cu_{0.2}B_{1.0}Al_{0.3}Ga_{0.1}Zr_{0.1}Nb_{0.1}Fe_{residual}$ |

It is further illustrated by the embodiments and the contrast examples that the method and the device according to the present invention significantly improve the magnetic performance, coercivity and corrosion resistance of the magnet. By respectively melting two alloys, one decrepitating and adding metal oxide micro-powder while jet milling, the present invention improves the structure of the powder, and forms the ground surface of the metal oxide for reducing the further oxidation of the magnetic powder. HR—Fe—B-Mb alloy powder absorbs around LR—Fe—B-Ma alloy powder, it is alloyed while sintering to form the special metallurgical structure of the present invention. Compared with Dy infiltration technique, the present invention is not limited by the shape and size of the magnet and is a very promising technology.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method of manufacturing an NdFeB rare earth permanent magnet with a composite main phase, wherein a raw material comprises LR—Fe—B-Ma alloy, HR—Fe—B-Mb alloy and metal oxide micro-powder, wherein the LR comprises at least two rare earth elements, and at least comprises Nd and Pr, the HR is selected from rare earth elements and comprises at least Dv, the Ma is selected from the group consisting of Al, Co, Nb, Ga, Zr, Cu, V and Mo, the Mb is selected from the group consisting of Al, Co, Nb, Ga, Zr, Cu, V, Ti, Cr, Ni, Hf, Y and Mo; wherein the method comprises steps of:

(1) melting the LR—Fe—B-Ma alloy which comprises:

firstly melting an LR—Fe—B-Ma raw material under vacuum or argon protection with induction heating for forming an alloy, refining before casting the alloy in a melted state onto a rotation roller with water cooling function through a tundish, and cooling the alloy with the rotation roller for forming alloy flakes, wherein an average grain size of each of the alloy flakes is 1.5-3.5 μm;

(2) melting the HR—Fe—B-Mb alloy which comprises:

firstly melting an HR—Fe—B-Mb raw material under vacuum or argon protection with induction heating for forming an alloy, refining before casting the alloy in a melted state onto a rotation roller with water cooling function through a tundish, and cooling the alloy with the rotation roller for forming alloy flakes, wherein an average grain size of each of the alloy flakes is 0.1-2.9 μm;

(3) alloy hydrogen decrepitating which comprises:

sending the LR—Fe—B-Ma alloy and the HR—Fe—B-Mb alloy into a vacuum hydrogen decrepitation device, evacuating before injecting hydrogen for hydrogen absorption, wherein a hydrogen absorption temperature is 80-300° C.; heating after hydrogen absorption and evacuating for dehydrogenating, wherein a dehydrogenating temperature is 350-900° C., a dehydrogenating time is 3-15 h; and then cooling the alloy;

(4) metal oxide powder surface adsorbing and powdering which comprises:

adding the LR—Fe—B-Ma alloy and the HR—Fe—B-Mb alloy which are hydrogen decrepitated in the step (3), and the metal oxide micro-powder into a mixer for mixing, wherein the mixing is made under nitrogen protection, lubricant or anti-oxidant may be added; and then powdering with jet milling after the mixing for obtaining alloy powder; and (5) magnetic field pressing, sintering and ageing which comprises:

under nitrogen protection, magnetic field pressing the obtained alloy powder in the step (4), and then sintering and ageing under vacuum or argon protection for manufacturing the NdFeB rare earth permanent magnet, wherein the powdering with jet milling comprises: under nitrogen atmosphere, adding the mixed powder into a hopper on a top portion of a feeder; moving the mixed powder into a milling room through the feeder; milling with air flow from a spray nozzle, wherein the powder milled rises with the air flow; sorting the milled powder with a sorting wheel and collecting in a cyclone collector; discharging powder coated with the metal oxide micro-powder from an air exhaust pipe of the cyclone collector with the air flow; collecting the powder coated with the metal oxide micro-powder in a collector after the cyclone collector, and then mixing under nitrogen protection.

2. A method of manufacturing an NdFeB rare earth permanent magnet with a composite main phase, wherein a raw material comprises LR—Fe—B-Ma alloy, HR—Fe—B-Mb alloy and metal oxide micro-powder, wherein the LR comprises at least two rare earth elements, and at least comprises Nd and Pr, the HR is selected from rare earth elements and comprises at least Dv, the Ma is selected from the group consisting of Al, Co, Nb, Ga, Zr, Cu, V and Mo, the Mb is selected from the group consisting of Al, Co, Nb, Ga, Zr, Cu, V, Ti, Cr, Ni, Hf, Y and Mo; wherein the method comprises steps of:

(1) melting the LR—Fe—B-Ma alloy which comprises:

firstly melting an LR—Fe—B-Ma raw material under vacuum or argon protection with induction heating for forming an alloy, refining before casting the alloy in a melted state onto a rotation roller with water cooling function through a tundish, and cooling the alloy with the rotation roller for forming alloy flakes, wherein an average grain size of each of the alloy flakes is 1.5-3.5 μm;

(2) melting the HR—Fe—B-Mb alloy which comprises:

firstly melting an HR—Fe—B-Mb raw material under vacuum or argon protection with induction heating for forming an alloy, refining before casting the alloy in a melted state onto a rotation roller with water cooling function through a tundish, and cooling the alloy with the rotation roller for forming alloy flakes, wherein an average grain size of each of the alloy flakes is 0.1-2.9 μm;

(3) alloy hydrogen decrepitating which comprises:

sending the LR—Fe—B-Ma alloy and the HR—Fe—B-Mb alloy into a vacuum hydrogen decrepitation device, evacuating before injecting hydrogen for hydrogen absorption, wherein a hydrogen absorption temperature is 80-300° C.; heating after hydrogen absorption and evacuating for dehydrogenating, wherein a dehydrogenating temperature is 350-900° C., a dehydrogenating time is 3-15 h; and then cooling the alloy;

(4) metal oxide powder surface adsorbing and powdering which comprises:

adding the LR—Fe—B-Ma alloy and the HR—Fe—B-Mb alloy which are hydrogen decrepitated in the step (3), and the metal oxide micro-powder into a mixer for mixing, wherein the mixing is made under nitrogen protection, lubricant or anti-oxidant may be added; and then powdering with jet milling after the mixing for obtaining alloy powder; and (5) magnetic field pressing, sintering and ageing which comprises:

under nitrogen protection, magnetic field pressing the obtained alloy powder in the step (4), and then sintering and ageing under vacuum or argon protection for manufacturing the NdFeB rare earth permanent magnet, wherein the magnetic field pressing comprises sending the alloy powder into a nitrogen protection sealed magnetic field pressing machine under the nitrogen protection, weighting before adding to a cavity of a mould already assembled, then magnetic field pressing; after pressing, opening the mould and obtaining a magnetic block; wrapping the magnetic block with a plastic or rubber bag under the nitrogen protection, sending the magnetic block with the plastic or rubber bag into an isostatic pressing machine for isostatic pressing, then sending the magnetic block with the plastic or rubber bag into a nitrogen protection loading tank of a vacuum sintering furnace; then removing the plastic or rubber bag of the magnetic block with gloves in the nitrogen protection loading tank and sending the magnetic block to a sintering case.

3. A method of manufacturing an NdFeB rare earth permanent magnet with a composite main phase, wherein a raw material comprises LR—Fe—B-Ma alloy, HR—Fe—B-Mb alloy and metal oxide micro-powder, wherein the LR comprises at least two rare earth elements, and at least comprises Nd and Pr, the HR is selected from rare earth elements and comprises at least Dv, the Ma is selected from the group consisting of Al, Co, Nb, Ga, Zr, Cu, V and Mo, the Mb is selected from the group consisting of Al, Co, Nb, Ga, Zr, Cu, V, Ti, Cr, Ni, Hf, Y and Mo; wherein the method comprises steps of:

(1) melting the LR—Fe—B-Ma alloy which comprises:

firstly melting an LR—Fe—B-Ma raw material under vacuum or argon protection with induction heating for forming an alloy, refining before casting the alloy in a melted state onto a rotation roller with water cooling function through a tundish, and cooling the alloy with the rotation roller for forming alloy flakes, wherein an average grain size of each of the alloy flakes is 1.5-3.5 μm;

(2) melting the HR—Fe—B-Mb alloy which comprises:

firstly melting an HR—Fe—B-Mb raw material under vacuum or argon protection with induction heating for forming an alloy, refining before casting the alloy in a melted state onto a rotation roller with water cooling function through a tundish, and cooling the alloy with the rotation roller for forming alloy flakes, wherein an average grain size of each of the alloy flakes is 0.1-2.9 μm;

(3) alloy hydrogen decrepitating which comprises:

sending the LR—Fe—B-Ma alloy and the HR—Fe—B-Mb alloy into a vacuum hydrogen decrepitation device, evacuating before injecting hydrogen for hydrogen absorption, wherein a hydrogen absorption temperature is 80-300° C.; heating after hydrogen absorption and evacuating for dehydrogenating, wherein a dehydrogenating temperature is 350-900° C., a dehydrogenating time is 3-15 h; and then cooling the alloy;

(4) metal oxide powder surface adsorbing and powdering which comprises:

adding the LR—Fe—B-Ma alloy and the HR—Fe—B-Mb alloy which are hydrogen decrepitated in the step (3), and the metal oxide micro-powder into a mixer for mixing, wherein the mixing is made under nitrogen protection, lubricant or anti-oxidant may be added; and then powdering with jet milling after the mixing for obtaining alloy powder; and (5) magnetic field pressing, sintering and ageing which comprises:

under nitrogen protection, magnetic field pressing the obtained alloy powder in the step (4) to obtain a magnetic block, and then sintering and ageing the magnetic block under vacuum or argon protection for manufacturing the NdFeB rare earth permanent magnet, wherein the sintering and ageing comprises sending a sintering case carrying the magnetic block in a nitrogen protection loading tank of a vacuum sintering furnace into a heating chamber of the vacuum sintering furnace under nitrogen protection, evacuating before heating, keeping a temperature at 200-400° C. for 2-10 h, then keeping the temperature at greater than 400° C. and less than or equal to 600° C. for 5-12 h, then pre-sintering by keeping the temperature at greater than 600° C. and less than or equal to 950° C. for 5-20 h to pre sinter, then sintering by keeping the temperature at greater than 950° C. and less than or equal to 1070° C. for 1-6 h to sinter, then first ageing at a temperature of 800-950° C. and second ageing at a temperature of 450-650° C., cooling after second ageing for manufacturing the sintered NdFeB permanent magnet, and then machining and surface-processing to manufacture various permanent magnetic devices.

4. The method, as recited in claim 3, wherein a density of the pre-sintered magnet is 7-7.4 g/cm$^3$, and a density of the sintered magnet is 7.5-7.7 g/cm$^3$.

5. The method, as recited in claim 3, wherein in the step of powdering with jet milling, powder collected by a cyclone collector and powder discharged from an air exhaust pipe of the cyclone collector are mixed under nitrogen protection, and then the mixed powder is for magnetic field pressing.

6. The method, as recited in claim 3, wherein the metal oxide micro-powder is $Dy_2O_3$ micro-powder heat-treated at a temperature of 600-1200° C.

7. The method, as recited in claim 3, wherein the metal oxide micro-powder is $Al_2O_3$ micro-powder.

8. The method, as recited in claim 3, wherein the metal oxide micro-powder is rare earth metal oxides except Lanthanum oxide and cerium oxide, or is selected from the group consisting of Al oxide, Co oxide, Nb oxide, Ga oxide, Zr oxide, Cu oxide, V oxide, Mo oxide, Fe oxide and Zn oxide.

9. The method, as recited in claim 3, wherein the metal oxide is selected from the group consisting of $Dy_2O_3$, $Tb_2O_3$ and $Al_2O_3$.

10. The method, as recited in claim 3, wherein after evacuating for dehydrogenating, a certain amount of hydrogen are injected within a temperature range of 100-600° C., and then the alloy is cooled.

11. The method, as recited in claim 3, wherein the LR—Fe—B-Ma alloy and the HR—Fe—B-Mb alloy which are hydrogen decrepitated, and the metal oxide micro-powder are added into the mixer for mixing, a certain amount of hydrogen is added while mixing.

12. The method, as recited in claim 3, wherein in the step (4), an average particle size of the obtained alloy powder is 1-3 μm.

* * * * *